United States Patent [19]

Trinkner

[11] 4,337,812

[45] Jul. 6, 1982

[54] COMBINED PICNIC BAG AND TABLECLOTH

[76] Inventor: Eileen Trinkner, 1819 Chalcedony St., Apt. #2, San Diego, Calif. 92109

[21] Appl. No.: 230,527

[22] Filed: Feb. 2, 1981

[51] Int. Cl.[3] ..... A45C 9/00

[52] U.S. Cl. ..... 150/11; 150/52 R

[58] Field of Search ..... 150/11, 52 R, 52 C

[56] References Cited

U.S. PATENT DOCUMENTS

| | | | |
|---|---|---|---|
| 1,509,930 | 9/1924 | Charsky . | |
| 1,606,538 | 11/1926 | Simeonoff | 150/11 X |
| 1,951,527 | 3/1934 | Oas | 190/42 |
| 2,479,203 | 8/1949 | Brown | 150/11 |
| 2,728,165 | 12/1955 | Runyon | 150/52 R |
| 2,731,997 | 1/1956 | Muth et al. | 150/11 |
| 3,097,782 | 7/1963 | Koropatkin et al. | 229/31 |
| 3,599,690 | 8/1971 | Christie | 150/11 |
| 3,976,113 | 8/1976 | Kim | 5/344 |

*Primary Examiner*—Donald F. Norton

*Attorney, Agent, or Firm*—Brown & Martin

[57] ABSTRACT

A combined picnic bag and tablecloth for use in organizing and carrying silverware, plates, and the like, transporting food and drink, and which also serves as a table cover. A pliable cover of appropriate size and shape is formed with a compartmented storage pocket substantially at the center of one surface. A flap having storage compartments on both its sides is hingedly attached to the pocket and folds over the pocket to secure in place the items stored within the pocket and flap compartments. A hem around the perimeter of the cover contains a draw cord that when grasped and pulled forms the cover into a bag for carrying food and beverages. Loops of the drawn cord serve as handles for carrying the bag. The cover is provided with a stiffening member and a padded section in way of the cover pocket. The stiffener member and padded section become the bottom of the bag and provide a protected base and storage form for the bag.

6 Claims, 5 Drawing Figures

COMBINED PICNIC BAG AND TABLECLOTH

BACKGROUND OF THE INVENTION

Out of door living is popular and takes many forms from camping in a rustic setting to an occasional picnic outing. A pleasurable activity in all such endeavors ia a meal served in the open and away from the customary support facilities. It adds to the enjoyment and efficiency of a picnic to have utensils, dishes, and other customary items conveniently available in an organized fashion with a minimum of transportation difficulty. Having a readily available cover or tablecloth to spread at the desired site further adds to the convenience and enjoyment of the meal. Picnic baskets and various containers permitting the storage of utensils and food items are available. Although the conventional picnic basket provides a means for carrying and protecting food, and in organizing silverware and serving materials, they are awkward to store and carry because of their shape and rigid construction. These disadvantages exist whether the basket is being used for a picnic or stored because of the volume necessarily occupied by the basket whether full or empty. With the usual picnic basket, the provision for a tablecloth requires that this separate item be carried, thus adding to the burden of organization, storage and transport. Some pliable containers to carry picnic items have been developed, but they lack security of storage, ease of organization, and do not provide a combined tablecloth. It is therefore desirable to provide a combined bag and tablecloth that functions not only as a container and organizer for silverware, plates, and the like, but also can carry food, and when opened becomes the tablecloth. Further, it is desirable that the container be of such form and construction as to be easily carried, be pliable for ease in handling and storage, and yet provide protection for its contents. The device should also be simple in design for ease of construction and cleaning.

The combined picnic bag and tablecloth disclosed herein fullfills the requirements outlined.

SUMMARY OF THE INVENTION

The invention relates to a container for the storage, organization, and transport of tableware and other dining items together with food and drink. More specifically, the invention relates to a picnic bag which also serves as a tablecloth when stretched out, and which has convenient storage for cutlery and other picnic supplies at its center.

A pliable cover consisting of two layers of material is formed with a hem adjacent to its outer perimeter. A draw cord threaded through the hem is graspable at two diametrically opposite openings in the hem so that the cover may be drawn into a bag form by pulling on the cord at these points. When drawn, the exposed cord loops serve as handles for the bag.

A pocket with internal compartments is located at the center of one side of the cover and is designed to receive and store items such as plates and longer knives. A stiffening member is placed between the cover layers and padding in the cover is provided in way of the pocket to provide protection for the pocket contents and a formed base for the bag. A flap with storage compartments on both sides is hingedly attached to the pocket so as to fold over to rest upon the pocket. For transport, the flap is secured in the folded position by ties secured to the flap and the pocket. When the flap is secured in this fashion and the cover drawn up in the form of a bag, the pocket portion of the cover serves as the bottom of the bag. When the cover is opened and spread out, the flap maybe released and layered back to provide organized and convenient access to the stored plates, silverware and other supplies stored within the flap and pocket compartments.

The primary object of the invention is to provide a new and improved combined picnic bag and tablecloth for use in organizing and carrying picnic items, and which when opened, maybe used as a tablecloth at the picnic site. The picnic bag is light in weight and pliable, and therefore easily carried and stored. It may be made from cloth or plastic, and is easily cleaned. The design is simple yet provides for the convenient organization and secure storage of picnic materials during transport. These together with other objects and advantages will become apparent in considering the details of construction and operation of the picnic bag as they are more fully described.

Reference will be made to the accompanying drawings wherein like numerals refer to like parts throughout and in which.

DETAILED DESCRIPTION OF THE DRAWINGS

Figure 1:
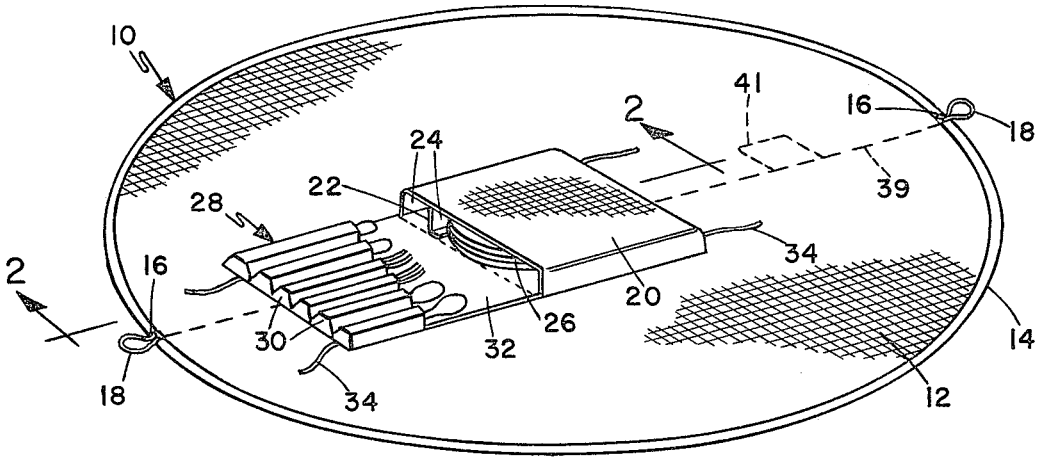
FIG. 1 is a perspective view of the picnic bag opened to form a tablecloth.
Figure 3:
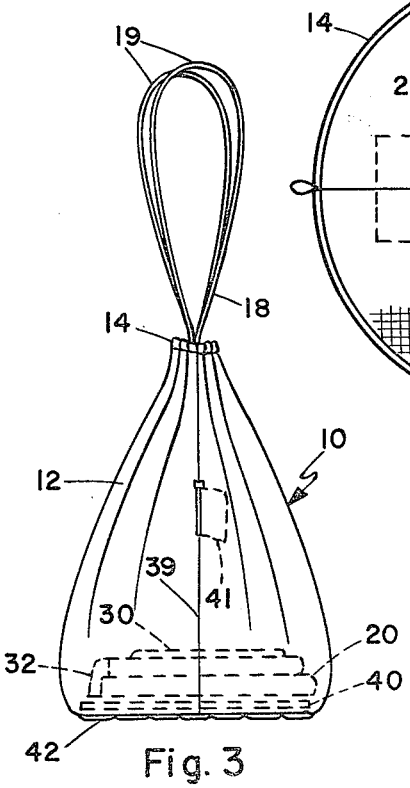
FIG. 3 is a side elevation view of the closed picnic bag.

The open picnic bag serves as a tablecloth and storage cupboard as illustrated in FIG. 1. In this embodiment, the cover 12 is made from pliable material and is circular in shape. A hem 14 is formed around perimeter of the cover 12. The hem 14 has two diametrically opposite openings 16. A continuous draw cord 18 is contained within the hem 14. Access to two portions of the draw cord 18 is gained through the openings 16 in the hem 14. When the draw cord is grasped and pulled taught at these latter portions, the cover 10 is drawn into the shape of a bag as illustrated in FIG. 3. The loops 19 of draw cord 18 then serve as handles for carrying picnic bag 10.

Pocket 20 is attached in the center of the interior surface of the cover 12. Pocket 20 has interior partitions 22 forming individual interior compartments 24 within pocket 20 for the storage of plates 26 and other food preparation or service items. In FIG. 1, flap 28 illustrated in its open position. Flap 28 is provided with storage compartments on both sides, as represented at 30, for organizing silverware, napkins, and other picnic items. Section 32 of flap 28 serves as a hinge permitting flap 28 to be folded over pocket 20 and secured by ties 34 as illustrated in FIG. 2.

Figure 2:
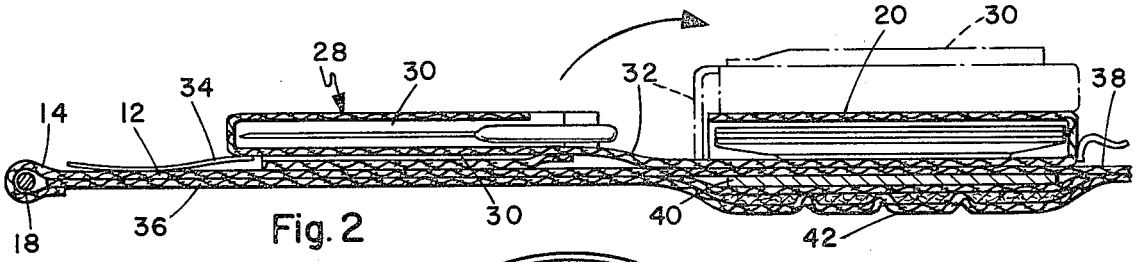
FIG. 2 is an enlarged sectional view taken on line 2—2 of FIG. 1.
Figure 4:
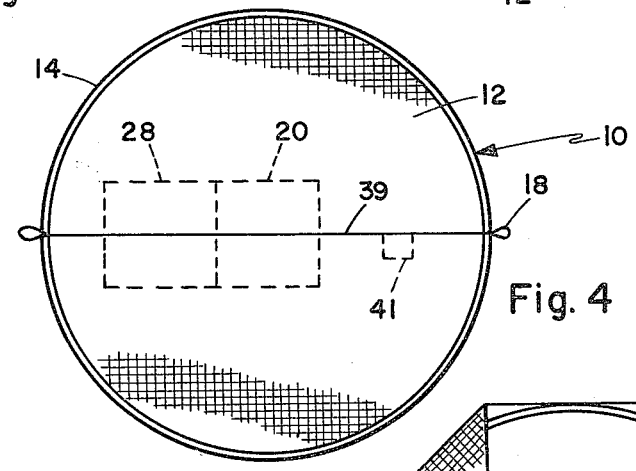
FIG. 4 is an underside view of the open tablecloth, on a reduced scale.
Figure 5:
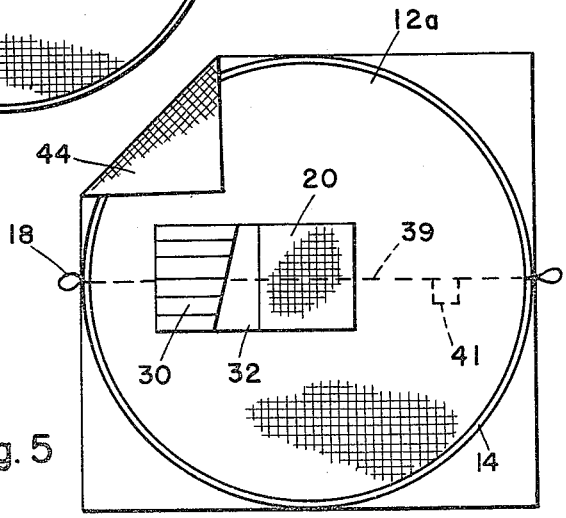
FIG. 5 is a top plan view of an alternative square configuration of the tablecloth.

As depicted in FIG. 2, the cover 12 is formed from two layers of material 36 and 38 secured together. The layers 36 and 38 may be either cloth or plastic, or the outer layer 36 may be a plastic or water resistant fabric, while the inner layer 38 is fashioned from a more attractive cloth. As illustrated in FIGS. 1, 4, and 5, outer layer 36 contains a seam 39 which extends across the cover 12 between the hem openings 16. The seam 39 is provided to facilitate the installation between the layers 36 and 38 of utility pockets, such as 41, which are accessable from the exterior of the bag 10. The outer perimeter of layer 38 of cover 12 is folded over the perimeter of layer 36 and secured thereto by stitching or other means to form hem 14. Draw cord 18 is threaded through hem 14 utilizing the openings 16 in the hem.

FIG. 2 illustrates the arrangement and positioning of pocket 20 and its flap 28 upon the interior layer 38 of cover 12. A stiffening member 40 of suitable rigid material is secured between the inner and outer layers 38 and 36 in way of the pocket 20 to provide form and protection for the bag. A padded section 42 is provided in the outer layer 36 in way of the pocket 20 to add further security for the bag contents. Flap 28 is illustrated in both its opened and folded position in FIG. 2. The storage compartment 30 of flap 28 opens toward the hinge section 32 so that when the flap 28 is folded over the pocket 20, as shown by the arrow, and secured by ties 34, the contents of the compartments of the pocket and flap are locked in place.

FIG. 4 is a view from the bottom of the bag 10 when it is spread as a tablecloth and indicates the positions of the pocket 20 and the flap 28 when the latter elements are opened.

The second embodiment of the combined picnic bag and tablecloth is illustrated in FIG. 5 wherein the cover **12*a* has a square shape. In this design, the corners 44 of the cover 12*a* may be folded inward before the draw cord 18 is pulled taught to form the bag. The corners 44** may also be left out before pulling the drawstrings.

OPERATION

To equip and organize picnic utensils and materials, the combined picnic bag and tablecloth is spread as illustrated in FIG. 1. The serving and eating items are placed in the compartments of the pocket 20 and flap 28. The flap 28 is then folded over the pocket 20 and secured by the ties 34, thus locking these items in place. Draw cord 18 is then grasped at the openings 16 in the hem 14 and pulled together to form a bag shape as shown in FIG. 3. Before closing the bag 10, food and drink items may be placed within the bag to rest upon the flap 28. The bag is carried by the loops 19 of draw cord 18 to the picnic site. Once there, the bag is opened to serve as a tablecloth and has the necessary materials and equipment conveniently available within the pocket 20 and flap 28.

Having described my invention, I claim.

1. A combined picnic bag and tablecloth comprising:

a pliable cover having an interior and exterior surface for providing a table-like setting, a circular hem formed adjacent the perimeter of the cover and containing two oppositely placed openings, a draw cord contained within the hem graspable through the hem openings for drawing the cover perimeter together to form a bag, a pocket with storage compartments therein spaced substantially in the center of the interior surface of the cover, a flap hinged to and foldable over the pocket, a flap having compartments for storage on its inner and outer surfaces, means for securing the flap in position over the pocket, at least one utility pouch formed in the cover accessible from the exterior surface thereof.

2. A combined picnic bag and tablecloth as recited in claim 1 wherein the cover further comprises:

an inner layer of material useable as a surface for the preparation and serving of food, an outer protective layer, the outer layer having a seam therein to provide access between the inner and outer layers.

3. A combined picnic bag and tablecloth as recited in claim 2 wherein:

a stiffening member spaced between the inner and outer layers of the cover in way of the pocket for providing increased storage form for the bag and protection for its contents, and a padded section formed in the outer layer of the cover in way of the pocket to serve as a protective base for the bag.

4. A combined picnic bag and tablecloth as recited in claim 3 wherein:

the storage compartments of the pocket and inner flap surface are closed when the flap is folded over the pocket to prevent removal of their contents.

5. A combined picnic bag and tablecloth as recited in claim 1 wherein:

the draw cord forms two carrying loops projecting from the hem openings when cover is drawn into a bag.

6. A combined picnic bag and tablecloth as recited in claim 1 wherein:

the cover is formed in the shape of a square, and the corners of the square are foldable inward toward the hem before the cover is drawn into the shape of a bag.

* * * * *